US009359815B2

(12) United States Patent
Nicolosi

(10) Patent No.: US 9,359,815 B2
(45) Date of Patent: Jun. 7, 2016

(54) DEVICE FOR CONTROLLING THE ACTUATION OF A GROUP FOR MOVING A CURTAIN/AWNING

(71) Applicant: PELLINI S.p.A., Codogno (IT)

(72) Inventor: Giovanni Nicolosi, Dresano (IT)

(73) Assignee: PELLINI S.P.A., Codogno (LO) (IT)

( * ) Notice: Subject to any disclaimer, the term of this patent is extended or adjusted under 35 U.S.C. 154(b) by 0 days.

(21) Appl. No.: 14/413,496

(22) PCT Filed: May 8, 2013

(86) PCT No.: PCT/IT2013/000134
§ 371 (c)(1),
(2) Date: Jan. 8, 2015

(87) PCT Pub. No.: WO2014/016856
PCT Pub. Date: Jan. 30, 2014

(65) Prior Publication Data

US 2015/0197983 A1 Jul. 16, 2015

(30) Foreign Application Priority Data

Jul. 25, 2012 (IT) ..... MI2012A1292

(51) Int. Cl.
*E06B 3/32* (2006.01)
*E06B 9/322* (2006.01)
(Continued)

(52) U.S. Cl.
CPC ..... *E06B 9/322* (2013.01); *E06B 9/264* (2013.01); *E06B 9/32* (2013.01); *E06B 2009/2646* (2013.01); *E06B 2009/3265* (2013.01)

(58) Field of Classification Search
CPC ..... E06B 9/322; E06B 9/264; E06B 9/32; E06B 2009/2646; E06B 2009/3265; E06B 9/326; E06B 2009/2643
USPC ..... 160/107, 150, 193, 258, 307, 319, 320, 160/321, 173 R, 178.1 R, 168.1 R, 178.2
See application file for complete search history.

(56) References Cited

U.S. PATENT DOCUMENTS 4,481,998 A * 11/1984 Strandberg ..... A47H 5/0325 160/126
4,865,109 A * 9/1989 Sherman ..... E06B 9/78 160/277

(Continued)

FOREIGN PATENT DOCUMENTS

CN 200971740 11/2007
DE 10 2009 009504 4/2010

(Continued)

OTHER PUBLICATIONS

International Search Report dated Aug. 27, 2013, corresponding to PCT/IT2013/000134.

*Primary Examiner* — Katherine Mitchell
*Assistant Examiner* — Johnnie A Shablack
(74) *Attorney, Agent, or Firm* — Young & Thompson

(57) ABSTRACT

A device for actuating a curtain/awning in a double glazing includes a pulley supported by support elements connected to connection elements integrally connected to a wall of the double glazing at the movement group. A ring of cord is partially wound around the pulley and is maintained taught by a tensioning element, it too connected to the wall of the double glazing. By applying a tension to the cord ring, a torque is generated tending to rotate the pulley. The torque is transmitted by suitable transmission elements to the group for moving the curtain/awning. The support elements of the pulley are separated from the connection elements for values of tension applied to the cord ring that are greater than a pre-established limit value. The separation cancels the tension of the cord.

16 Claims, 6 Drawing Sheets

(51) Int. Cl.

| | |
|---|---|
| ***E06B 9/264*** | (2006.01) |
| ***E06B 9/32*** | (2006.01) |
| *E06B 9/326* | (2006.01) |

(56) References Cited

U.S. PATENT DOCUMENTS

| | | | | | |
|---|---|---|---|---|---|
| 5,137,073 | A * | 8/1992 | Huang | E06B 9/78 | 160/319 |
| 5,242,006 | A * | 9/1993 | Ortega | A47H 11/06 | 16/219 |
| 5,553,650 | A * | 9/1996 | Jelic | E06B 9/326 | 16/442 |
| 5,577,543 | A * | 11/1996 | Jelic | E06B 9/326 | 16/442 |
| 5,752,558 | A * | 5/1998 | Lin | E06B 9/326 | 16/219 |
| 5,769,142 | A | 6/1998 | Nicolosi | | |
| 5,839,492 | A * | 11/1998 | Young | E06B 9/264 | 160/107 |
| 5,845,696 | A * | 12/1998 | Chou | E06B 9/36 | 160/178.1 V |
| 5,906,233 | A * | 5/1999 | May | E06B 9/326 | 160/178.1 R |
| 6,085,824 | A * | 7/2000 | Cadorette | E06B 9/326 | 160/177 V |
| 6,116,325 | A * | 9/2000 | Colson | E06B 9/32 | 160/321 |
| 6,749,000 | B2 * | 6/2004 | Bohlen | E06B 9/322 | 160/178.1 R |
| 6,792,999 | B2 * | 9/2004 | Cross | A47H 3/08 | 160/321 |
| 7,114,544 | B2 * | 10/2006 | Rice | E06B 9/322 | 160/178.1 V |
| 7,124,803 | B2 * | 10/2006 | Jin | E06B 9/264 | 160/107 |
| 7,234,501 | B1 * | 6/2007 | Park | E06B 9/264 | 160/107 |
| 7,302,738 | B2 * | 12/2007 | Nien | E06B 9/326 | 160/178.1 R |
| 7,931,069 | B2 * | 4/2011 | Cannaverde | E06B 9/38 | 160/170 |
| 8,132,610 | B2 * | 3/2012 | Lin | E06B 9/40 | 160/243 |
| 8,286,686 | B2 * | 10/2012 | Cannaverde | E06B 9/326 | 160/178.1 R |
| 8,336,598 | B1 * | 12/2012 | Chang | E06B 9/56 | 160/177 V |
| 8,360,130 | B2 * | 1/2013 | Cannaverde | E06B 9/322 | 160/170 |
| 8,499,814 | B2 * | 8/2013 | Ng | E06B 9/324 | 160/168.1 R |
| 8,505,609 | B2 * | 8/2013 | Huang | E06B 9/42 | 160/293.1 |
| 8,539,645 | B2 * | 9/2013 | Marocco | A47H 3/08 | 160/178.1 R |
| 8,615,850 | B2 * | 12/2013 | Lee | F16G 11/00 | 160/178.1 R |
| 8,850,668 | B2 * | 10/2014 | Chen | E06B 9/262 | 160/177 R |
| 8,935,832 | B2 * | 1/2015 | Chuang | A47H 3/02 | 160/178.2 |
| 9,038,696 | B2 * | 5/2015 | Lava | E06B 9/326 | 160/321 |
| 9,091,117 | B2 * | 7/2015 | Ng | E06B 9/42 | |
| 9,161,649 | B2 * | 10/2015 | Rastegar | A47H 5/0325 | |
| 9,175,512 | B2 * | 11/2015 | Lu | E06B 9/326 | |
| 2003/0111188 | A1 * | 6/2003 | Cross | A47H 3/08 | 160/84.01 |
| 2003/0145959 | A1 | 8/2003 | Bohlen | | |
| 2006/0027338 | A1 | 2/2006 | Kim et al. | | |
| 2006/0048907 | A1 * | 3/2006 | Rice | E06B 9/322 | 160/178.1 V |
| 2007/0051477 | A1 * | 3/2007 | Fraser | E06B 9/262 | 160/84.05 |
| 2008/0251622 | A1 * | 10/2008 | Randall | E06B 9/326 | 242/375.2 |
| 2009/0205788 | A1 * | 8/2009 | Cannaverde | E06B 9/38 | 160/168.1 R |
| 2011/0035908 | A1 | 2/2011 | Chen | | |
| 2011/0036517 | A1 * | 2/2011 | Chen | E06B 9/326 | 160/319 |
| 2011/0247768 | A1 * | 10/2011 | Kwak | E06B 9/326 | 160/319 |
| 2012/0097343 | A1 * | 4/2012 | O'Hair | E06B 9/307 | 160/168.1 R |
| 2012/0211180 | A1 * | 8/2012 | Lin | E06B 9/326 | 160/368.1 |
| 2012/0279021 | A1 * | 11/2012 | Marocco | A47H 3/08 | 24/136 K |
| 2014/0359976 | A1 * | 12/2014 | Lu | E06B 9/326 | 24/116 A |
| 2015/0197983 | A1 * | 7/2015 | Nicolosi | E06B 9/264 | 160/107 |
| 2015/0246788 | A1 * | 9/2015 | Nien | B65H 75/4431 | 242/376 |
| 2015/0275576 | A1 * | 10/2015 | Lava | E06B 9/326 | 160/321 |

FOREIGN PATENT DOCUMENTS

| | | |
|---|---|---|
| EP | 2 530 234 | 12/2012 |
| WO | 2012/125036 | 9/2012 |

* cited by examiner

DEVICE FOR CONTROLLING THE ACTUATION OF A GROUP FOR MOVING A CURTAIN/AWNING

FIELD OF APPLICATION OF THE INVENTION

The present invention refers to the field of movable curtains/awnings, of shutters and similar structures mainly employed to prevent or obstruct the passage of light, air, sound waves and people through an opening in a wall. These movable structures can also be used for mutually separating two settings, for privacy reasons. Below in the present description, with the word "curtain/awning" it is intended to identify all movable structures of the aforesaid type.

More precisely, the present invention refers to the devices for controlling the actuation of a group for moving a curtain/awning. Still more precisely, the present invention refers to control devices of the type "with cord", in which the movement of the curtain/awning is controlled by means of a cord.

REVIEW OF THE PRIOR ART

In the devices referred to by the present invention, the cord that controls the movement of the curtain/awning is a so-called "continuous" cord, i.e. having two ends joined together so as to form a ring of cord. The cord is maintained taught by a pair of coplanar pulleys, and around each pulley the cord is wound for a section equal to a semi-circumference. Given that the cord is continuous, the two pulleys are joined by two cord sections in diametrically opposite positions with respect to each pulley. One of the two pulleys is coupled to the movement group for the curtain/awning and below in the present description this pulley is identified with the expression "drive pulley". The other pulley is idle and, serving to keep the cord taught, is indicated below in the present description with the expression "tensioning pulley". The drive pulley is supported by support means suitable for allowing the pulley to rotate and connected to the movement group for the curtain/awning. The tensioning pulley is connected to a fixed structure, i.e. with respect to which the movement of the curtain/awning occurs, or if the two pulleys are vertically aligned with the drive pulley placed at the greater height, the tensioning pulley can be supported by the drive pulley by means of the cord. In such case, the tensioning of the cord is due to the weight of the tensioning pulley. The drive pulley has a groove for the housing of the cord section wound around the pulley. The width of the groove is less than the diameter of the cord and the tension produced by the tensioning pulley is such to force the cord into the groove, in a manner such that the cord is integrally connected to the drive pulley at the section in which they are in contact with each other. This ensures that by applying a force at one of the two cord sections that join the pulleys, a torque is generated that tends to rotate the drive pulley. Such torque is transmitted to the movement group by transmission means so as to cause the movement of the curtain/awning.

As an alternative to the tensioning pulley, the device can comprise a return element around which the cord is partially wound, and on which the cord slides during the movement of the curtain/awning.

As an alternative to the cord, it is possible to employ another flexible member extended in length, such as a chain. In such case, the drive pulley and the tensioning pulley are gear wheels and the tensioning ensures the meshing between the wheels and the chain. Below in the present description, with the word "cord" it is intended to identify all the flexible members extended in length of the aforesaid type.

In the devices referred to by the present invention, the cord ring must be accessible to the person who intends to move the curtain/awning, so that the cord can be actuated. This, together with the continuity of the cord, makes these devices extremely dangerous, especially for children who could be choked in domestic accidents, e.g. due to the unintentional insertion of the head inside the ring of cord. In order to attempt to prevent these accidents, the cord must break for any improper use thereof, or more generally in use conditions different from those of functioning. Unfortunately, the structural and reliability requirements dictate that the cord cannot have openable joints, and that it has an ultimate strength considerably greater than the body weight of a child. The importance of the aforesaid drawback is also demonstrated by the recent laws of the European Community, which require builders of movement devices to confront this problem.

OBJECTS OF THE INVENTION

Object of the present invention is to overcome the aforesaid drawbacks by indicating a device for controlling the actuation of a group for moving a curtain/awning, of the type with continuous cord, which offers greater safety guarantees with respect to existing devices.

SUMMARY OF THE INVENTION

Subject of the present invention is a device for controlling the actuation of a group for moving a curtain/awning, said device being coupled to said movement group and comprising:

- at least one pulley rotating around its own axis;
- support means of the pulley, said means being connected to said movement group and being suitable for allowing the rotation of the pulley;
- a ring of cord at least partially wound around the pulley, having two cord sections moving away from the pulley in the same direction, in diametrically opposite positions with respect to the pulley, a tension applied to one of said cord sections generating a torque tending to rotate the pulley;
- means for transmitting said torque from the pulley to said movement group so as to cause said movement;

wherein according to the invention said support means support the pulley for a value of tension applied to at least one of said cord sections that is lower than a pre-established value, the exceeding of said value causing the disconnection of said support means from said movement group.

Further innovative characteristics of the present invention are described in the dependent claims.

According to one aspect of the invention, said support means are separated from said movement group by means of a physical separation element, said support means being connected to a connection element integral with said physical separation element at said movement group.

According to another aspect of the invention, said physical separation element is a wall of a double glazing.

According to another aspect of the invention, said cord ring is at least partially wound around a tensioning means of said cord, said tensioning means being integral with said physical separation element.

According to another aspect of the invention, the disconnection of said support means from said connection element cancels the tension of the cord.

According to another aspect of the invention, the connection element comprises:

means for translating the support means with respect to said connection element due to the tension of the cord;

means for preventing said translation for a value of tension applied to at least one of said cord sections that is lower than said pre-established value.

According to another aspect of the invention, the translation of the support means with respect to said connection element involves the separation of the support means from the connection element.

According to another aspect of the invention, said connection element and said support means comprise:

at least two walls integrally connected to said connection element, between which said support means are at least partially insertable;

at least two protuberances integrally connected to said support means;

at least two mutually parallel grooves, respectively obtained in the two walls, each groove having a first end and a second end, the first end being at an edge of one of the two walls for the insertion of one of the two protuberances in the groove, the grooves being blind at the second end;

the sliding of the protuberances in the grooves giving rise to said translation of the support means with respect to the connection element, the tension of the cord making the protuberances slide from the second end towards the first end of the grooves.

According to another aspect of the invention, the prevention means comprise a tongue having a first end and a second end, the tongue being integrally connected to the connection element at the first end, the tongue having a tooth at the second end, the support means being pressed against said tooth at a contact zone by the tension of the cord when the two protuberances are at the second ends of the grooves, the first end of the tongue and said contact zone being arranged along a direction oblique to the direction of said translation, the pressure of the support means against said tooth causing, for a value of tension applied to at least one of said cord sections that is equal to or greater than said pre-established value, a bending of the tongue due to which the contact between the support means and the tooth is reduced until it is nullified.

According to another aspect of the invention, the tensioning means comprise:

a first component integrally connected to said physical separation element and comprising a return element around which the ring of cord is at least partially wound so as to cause said tensioning of the cord;

a second component that oscillates with respect to the first component starting from a position in which the first component and the second component are opposite and the cord section wound around the return element is enclosed between said two components;

means for locking the second component when the latter is situated in said position.

According to another aspect of the invention, the locking means comprise a retractable tooth housable in an opening obtained in the second component, the housing of the retractable tooth in said opening being possible when the tooth is completely extended and the second component is situated in said position, the housing of the tooth in said opening preventing the second component from rotating with respect to the first component, a spring being compressed between said retractable tooth and the first component so that the elastic force of the spring makes the retractable tooth extend, the second component being adapted to be released only by exerting a pressure on the retractable tooth that is greater than the elastic force of the spring.

According to another aspect of the invention, the return element is connected to said first component by means of means suitable for allowing the translation of the return element with respect to the first component due to the tension of the cord, said spring being compressed between said retractable tooth and the return element so that the tension of the cord further compresses the spring.

According to another aspect of the invention, the return element is in contact with the cord at a surface whose shape is that of the side surface of a cylinder.

According to another aspect of the invention, the pulley and the return element have the same diameter.

BRIEF DESCRIPTION OF THE FIGURES

Further objects and advantages of the present invention will be clearer from the following detailed description of an embodiment thereof and from the enclosed drawings, given as merely exemplifying and non-limiting, in which.

DETAILED DESCRIPTION OF SEVERAL PREFERRED EMBODIMENTS OF THE INVENTION

Below in the present description, for descriptive ease, reference is only made to a preferred embodiment of the invention, but it must be clear that the described device is not limited to the aforesaid embodiment but can be employed for controlling the actuation of a group for moving any one curtain/awning. A figure can also be illustrated with reference to elements not expressly indicated in that figure but in other figures. The scale and proportions of the various depicted elements do not necessarily correspond to actual scale and proportions.

Figure 1:
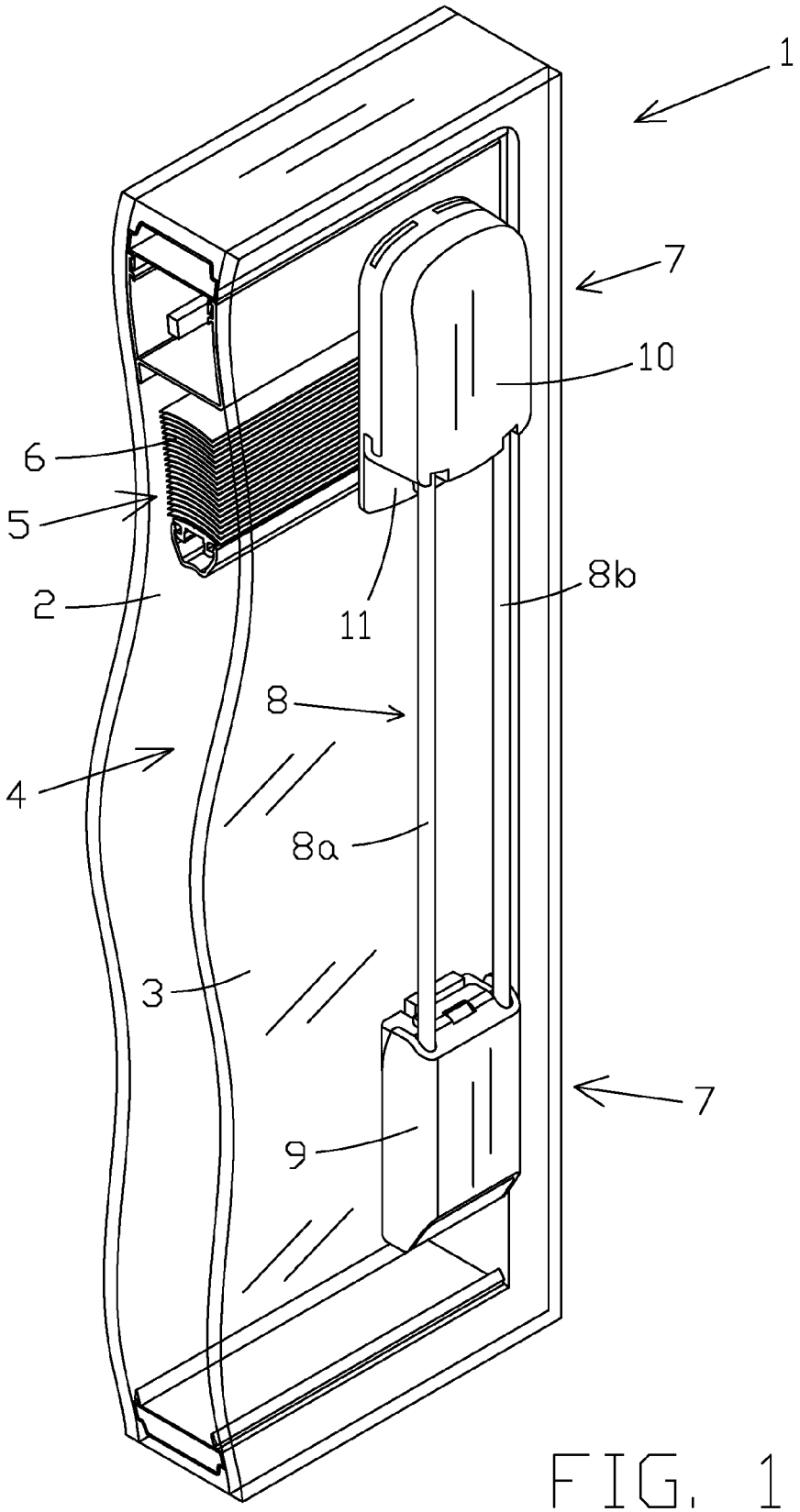
FIG. 1 shows, in perspective view, a device for controlling via a cord ring the actuation of a group for moving a Venetian blind-like curtain/awning housed in a double glazing, according to the present invention.

With reference to FIG. 1, a structure 1 is illustrated known as a "double glazing" and comprising two glass panes 2 and 3 parallel to each other and supported by a metallic frame interposed with said glass panes 2 and 3. By way of example, the glass panes 2 and 3 are arranged vertically. The frame and the glass panes 2 and 3 delimit a parallelepiped chamber 4 within which the Venetian blind-like curtain/awning 5 is placed. The curtain/awning 5 comprises a plurality of slats 6 translatable between the two panes 2 and 3, parallel thereto, by means of a movement group (not visible in the figures). The actuation of the movement group is controlled by a device 7 coupled to the movement group and comprising a drive pulley (not visible in the figures) around which a ring of cord 8 is wound, kept taught by a suitable tensioning element 9 connected to the glass pane 3. The cord ring 8 preferably lies in a plane parallel to the glass panes 2 and 3. The drive pulley is enclosed within a container 10 connected to the glass pane 3 by means of a connection element 11. The latter is integrally connected to the glass pane 3 and is placed between the container 10 and the glass pane 3. The container 10 supports the pulley, allowing the rotation thereof around its own axis preferably orthogonal to the glass pane 3, and keeping it coplanar to the cord ring 8. Below in the present description, the container 10 is identified with the word "slide". Two sections 8*a* and 8*b* of the cord 8 are preferably vertically extended from the slide 10 to the tensioning element 9, moving away from the drive pulley and in diametrically opposite positions with respect to said pulley.

By way of example, the drive pulley has a diameter preferably comprised between 18 mm and 25 mm, and still more preferably is 22 mm; the cord 8 is made of polyester and has a cross section with diameter preferably comprised between 3.8 mm and 4.1 mm, and still more preferably is 4 mm; the cord ring 8 has a length preferably comprised between 500 mm and 2000 mm, and still more preferably is 85 mm lower than the height of the glass pane 3; the tension of the cord 8 at the sections 8*a* and 8*b*, and due only to the presence of the tensioning element 9, is preferably comprised between 1 N and 2 N, and still more preferably is 1.5 N.

By applying a tension to one of the cord sections 8*a* and 8*b*, a torque is generated tending to rotate the drive pulley. The movement group for the curtain/awning 5 comprises an actuation pulley placed inside the chamber 4 of the double glazing 1 and magnetically coupled to the drive pulley in a known manner. Said magnetic coupling causes a connection between the slide 10 and the movement group. Due to the magnetic attraction between the drive pulley and the actuation pulley, the torque applied to the drive pulley and generated by means of the cord 8 is transmitted to the actuation pulley, which rotates other pulleys for winding and unwinding the support ropes for the slats 6. The application of a tension to one of the two cord sections 8*a* and 8*b* thus causes the translation of the slats 6, i.e. the movement of the curtain/awning 5. By way of example, the minimum tension to be applied to one of the two cord sections 8*a* and 8*b* in order to cause the translation of the slats 6 is preferably comprised between 6 N and 16 N, and still more preferably is 11 N.

As will be clear from the description of the subsequent figures, the connection between the slide 10 and the connection element 11 is such that the slide 10 supports the drive pulley for values of tension applied to at least one of the two cord sections 8*a* and 8*b* lower than a value that depends on the design parameters of the device 7. Exceeding said value causes the separation of the slide 10 from the connection element 11, i.e. the disconnection of the slide 10 from the movement group for the curtain/awning 5 and consequent cancellation of the tension of the cord 8.

Figure 2:
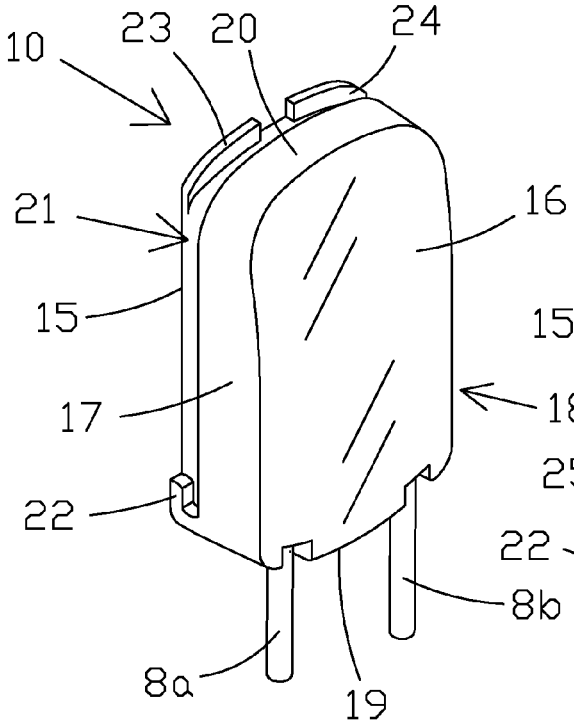
FIG. 2 shows, in perspective view, a component of the device of FIG. 1 acting as support means of a pulley coupled to the movement group for the curtain/awning and actuated by means of the cord.

With reference to FIG. 2, the slide 10 is illustrated, preferably with rectangular parallelepiped shape. Such slide has a base 15 with area slightly less than the opposite base 16 and joined thereto by two mutually parallel longitudinal lateral walls 17 and 18, and by two mutually parallel transverse lateral walls 19 and 20. The slide 10 is symmetric with respect to a plane parallel to the longitudinal walls 17 and 18, and orthogonal to the bases 15 and 16. The transverse wall 19 has two holes for the entrance in the slide 10 of the two cord sections 8*a* and 8*b*. Due to the lower area of the base 15 with respect to the base 16, the longitudinal walls 17 and 18 and the transverse wall 20, being extended from the base 16 to the base 15, form a step that delimits a U-shaped recess 21 starting from the base 15. Two short protuberances 22 (of which only one is visible in the figures) project from the transverse wall 19 starting from the two respective edges of the transverse wall 19 common with the longitudinal walls 17 and 18. The protuberances 22 are extended into the recess 21, in a manner parallel to the longitudinal walls 17 and 18. Two coplanar tabs 23 and 24 project orthogonally from the transverse wall 20, partially occupying the recess 21, in manner parallel to the base 15 and in the direction of the longitudinal walls 17 and 18. The tabs 23 and 24 lie on opposite sides with respect to the plane of symmetry of the slide 10.

Figure 3:
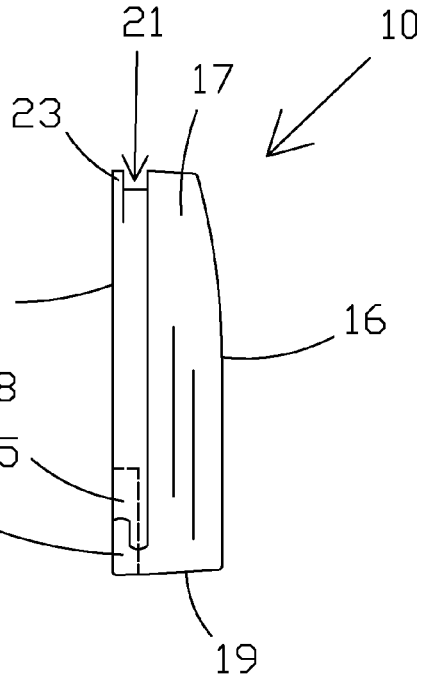
FIG. 3 shows, in side view, the support means of FIG. 2.

With reference to FIGS. 2 and 3, it is possible to observe that the slide 10 has a notch 25 at the base with greater area 15, starting from the transverse wall 19. The notch 25 has rectangular parallelepiped shape and is longitudinally traversed by the plane of symmetry of the slide 10.

Figure 4:
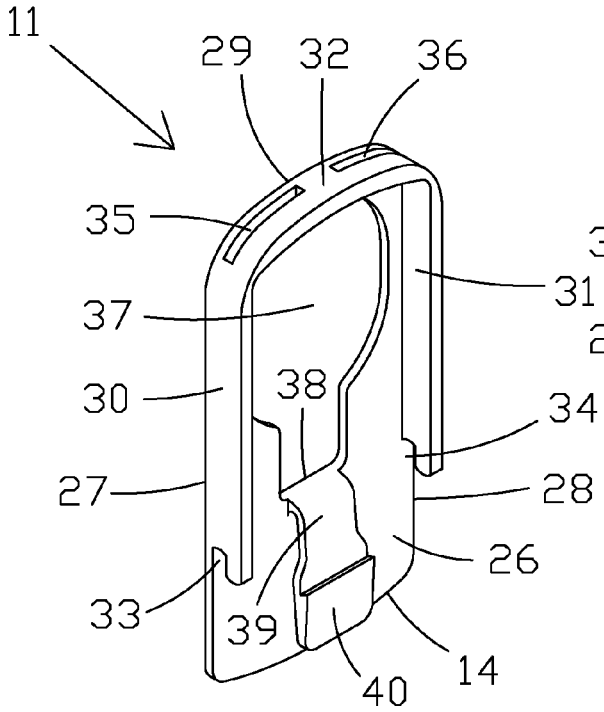
FIG. 4 shows, in perspective view, an element for connecting the support means of FIG. 2 to a pane of the double glazing of FIG. 1.
Figure 5:
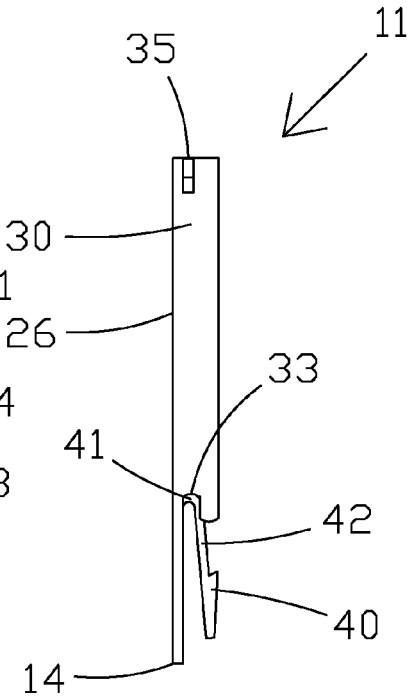
FIG. 5 shows, in side view, the connection element of FIG. 4.

With reference to FIGS. 4 and 5, the connection element 11 is illustrated, comprising a preferably rectangular base 26 having two long edges 27 and 28 and two short edges 29 and 14. Two mutually parallel longitudinal walls 30 and 31 respectively extend upward from the long edges 27 and 28, orthogonally with respect to the base 26 and on the same side with respect thereto. A transverse wall 32 extends upward from the short edge 29, orthogonal to the base 26 and on the same side as the longitudinal walls 30 and 31. The connection element 11 is symmetric with respect to a plane orthogonal to the base 26 and parallel to the longitudinal walls 30 and 31. The walls 30, 31 and 32 have the same height. The longitudinal walls 30 and 31 are shorter than the long edges 27 and 28 and have an edge in common with the transverse wall 32. The longitudinal walls 30 and 31 have two respective longitudinal grooves 33 and 34 that are extended parallel to the base 26 starting from the edges of the walls 30 and 31 not in common with the transverse wall 32. The latter has two windows 35 and 36 with elongated form parallel to the base 26 and lying on opposite side with respect to the plane of symmetry of the connection element 11. The base 26 has a through hole 37 placed between the walls 30, 31 and 32, whose edge has a section 38 closer to the short edge 14 of the base 26. The section 38 of the edge of the hole 37 is arranged orthogonal to the longitudinal walls 30 and 31 and is symmetric with respect to the plane of symmetry of the connection element 11. A tongue 39 is connected to the base 26 at the section 38 of the edge of the hole 37 and lies on the same side as the walls 30, 31 and 32 with respect to the base 26. The tongue 39 is extended towards the short edge 14 of the base 26 and has a tooth 40 at the end opposite that of connection to the base 26. The tooth 40 preferably extends orthogonally upward from the tongue 39 on the side opposite the base 26 with respect to the tongue 39.

With reference to FIG. 5, it is possible to observe that the section 38 of the edge of the hole 37 is nearly aligned with the blind end of the grooves 33 and 34. The cross section of the tongue 39 has, starting from the base 26, a first curved section 41 that continues into a second rectilinear section 42, at the end of which the tooth 40 is placed. The curved section 41 preferably has semi-circumference shape with the concavity directed towards the short edge 14 of the base 26. The rectilinear section 42 is slightly tilted with respect to the base 26 so as to be moved away from the latter starting from the section 41. The length of the section 42 is such that the free end of the tongue 39 is close to the short edge 14 of the base 26.

By way of example, the radius of the curved section 41 of the tongue 39 is preferably comprised between 0.8 mm and 0.9 mm, and still more preferably is 0.85 mm. The length of the section 42 of the tongue 39 is preferably comprised between 9.8 mm and 10.2 mm, and still more preferably is 10 mm. The distance of the free end of the tongue 39 from the base 26 is preferably comprised between 3.3 mm and 3.5 mm, and still more preferably is 3.4 mm. The slide 10 and the connection element 11 are preferably made of polycarbonate. Preferably, the long edges 27 and 28 of the connection element 11 have length greater than that of the longitudinal walls 17 and 18 of the slide 10. Preferably, the grooves 33 and 34 of the longitudinal walls 30 and 31 of the connection element 11 are respectively complementary to the protuberances 22 that project from the transverse wall 19 of the slide 10. Preferably the windows 35 and 36 in the transverse wall 32 of the connection element 11 are respectively complementary to the tabs 23 and 24 that project from the transverse wall 20 of the slide 10. Preferably the walls 30, 31 and 32 of the connection element are complementary to the recess 21 of the walls 17, 18 and 20 of the slide 10. Preferably, the distance from the base 16 of the free end of the tongue 39 is greater than the depth of the notch 25 starting from the base 15 of the slide 10.

FIGS. 6-10 illustrate several steps of a sequence of steps for connecting the slide 10 to the connection element 11. Before carrying out such connection, it is necessary to integrally connect the connection element 11 at the base 26, to the glass pane 3 at the movement group of the curtain/awning 5. In particular, the connection element 11 adheres to the glass pane 3 at the face of the base 26 opposite that from which the walls 30, 31 and 32 extend upward. The hole 37 in the base 26 of the connection element 11 facilitates the magnetic coupling between the drive pulley within the slide 10 and the actuation pulley within the chamber 4 of the double glazing 1. The connection element 11 is fixed to the glass pane 3 preferably in a manner such that the longitudinal walls 30 and 31 are vertically arranged.

Figure 6:
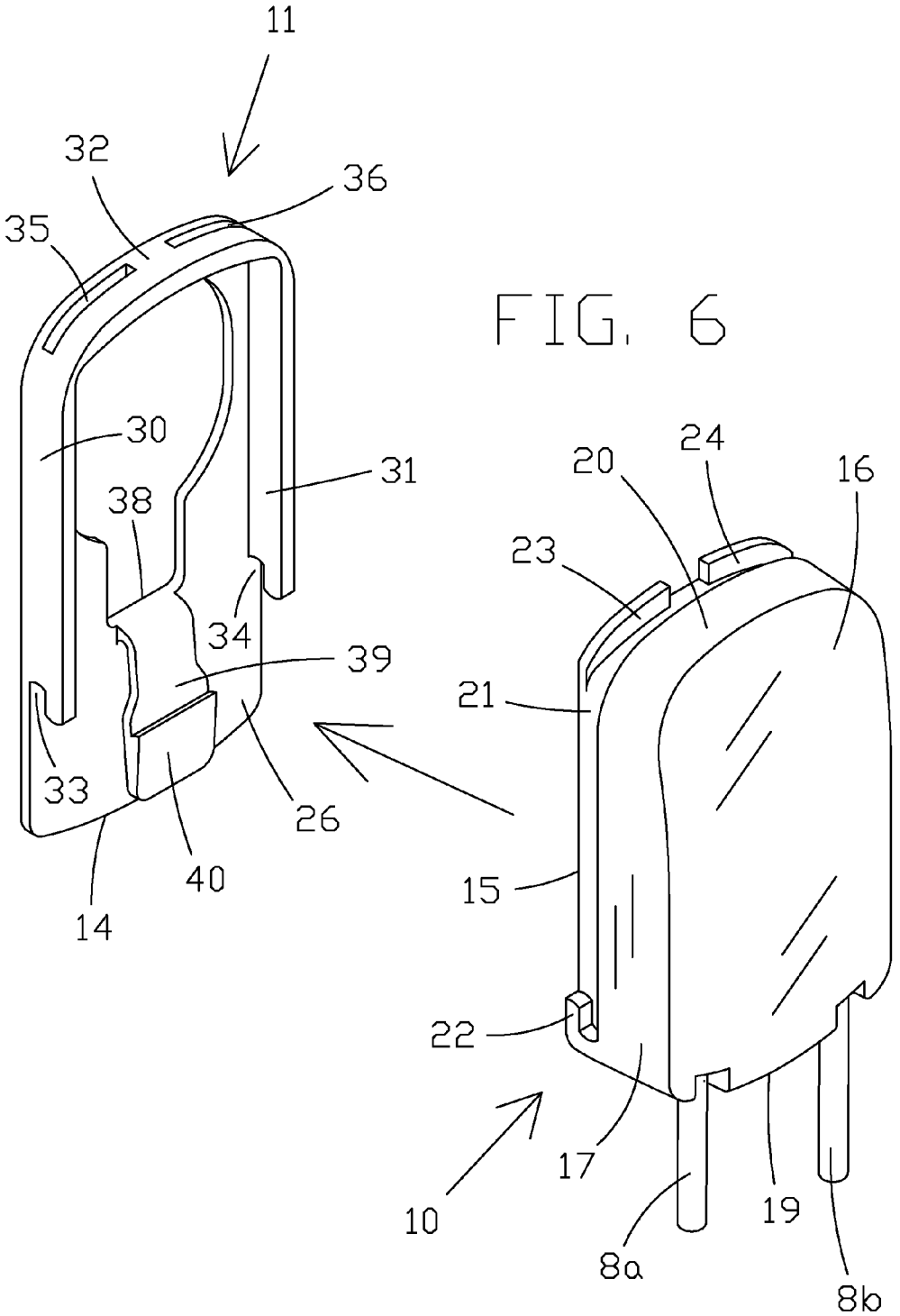
FIG. 6 shows, in perspective view, the support means of FIG. 2 and the connection element of FIG. 4 during one step of a sequence of steps for connecting the support means of FIG. 2 to the connection element of FIG. 4.
Figure 7:
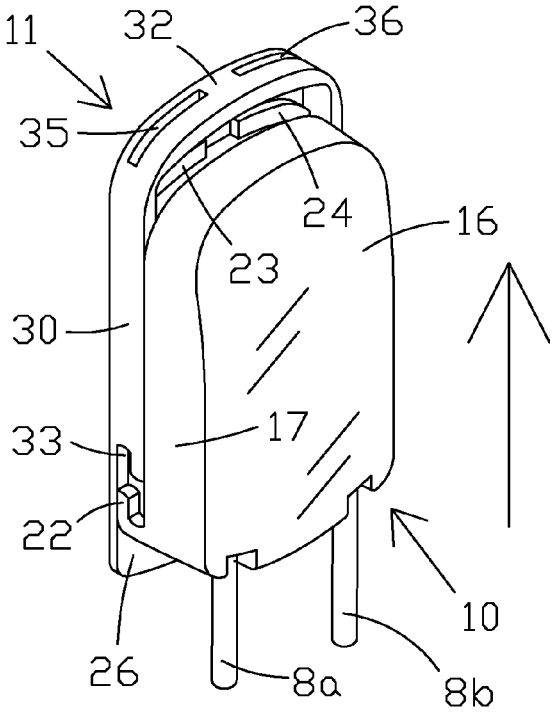
FIG. 7 shows, in perspective view, the support means of FIG. 2 and the connection element of FIG. 4 during a step following that illustrated in FIG. 6.
Figure 8:
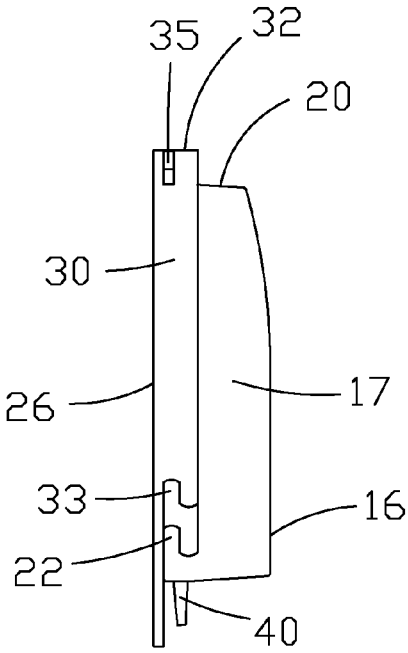
FIG. 8 shows the assembly of FIG. 7 in side view.

With reference to FIG. 6, the step is illustrated in which the slide 10 is superimposed on the connection element 11 in a manner such that the base 15 of the slide 10 comes into contact with the base 26 of the connection element 11. FIGS. 7 and 8 show the slide 10 and the connection element 11 after said superimposition has been carried out.

With reference to FIG. 7 it is possible to observe that the longitudinal walls 30 and 31 of the connection element 11 partially occupy the recess 21 at the longitudinal walls 17 and 18 of the slide 10. The latter is therefore partially inserted between the longitudinal walls 30 and 31 of the connection element 11. The transverse wall 32 of the connection element 11 does not occupy the recess 21 at the transverse wall 20 of the slide 10. The protuberances 22 of the slide 10 therefore face the respective grooves 33 and 34 of the connection element 11 without penetrating them. Analogously, the tabs 23 and 24 of the slide 10 face the windows 35 and 36 in the transverse wall 29 of the connection element 11 without penetrating them.

With reference to FIG. 8, it is possible to observe that the notch 25 in the base 15 of the slide 10 is partially occupied by the tongue 39 and by the tooth 40. In particular, due to the superimposition of the slide 10 on the connection element 11, the wall delimiting the notch 25 parallel to the base 15 is in contact with the tooth 40. Given that the distance of the free end of the tongue 39 from the base 16 is greater than the depth of the notch 25 starting from the base 15, with respect to the position shown in FIG. 6 the tongue 39 is bent and pressed towards the base 26 of the connection element 11 by the slide 10. The tongue 39 is provided with an elasticity such that it tends to return to the position of FIG. 6. This ensures that in the configuration shown in FIGS. 7 and 8, the tongue 39 exerts on the slide 10 a force tending to move the slide 10 away from the connection element 11. In order to maintain the slide 10 in the configuration illustrated in FIGS. 7 and 8, it is therefore necessary to press the slide 10 against the connection element 11 in a manner so as to overcome said elastic return force of the tongue 39.

The step following the superimposition of the slide 10 on the connection element 11 consists of moving the slide 10 towards the transverse wall 32 of the connection element 11, in the direction indicated by the arrow of FIG. 7. Said translation causes the sliding of the protuberances 22 of the slide 10 in the grooves 33 and 34 of the connection element 11 and the sliding of the tabs 23 and 24 of the slide 10 in the windows 35 and 36 of the transverse wall 29 of the connection element 11.

Figure 9:
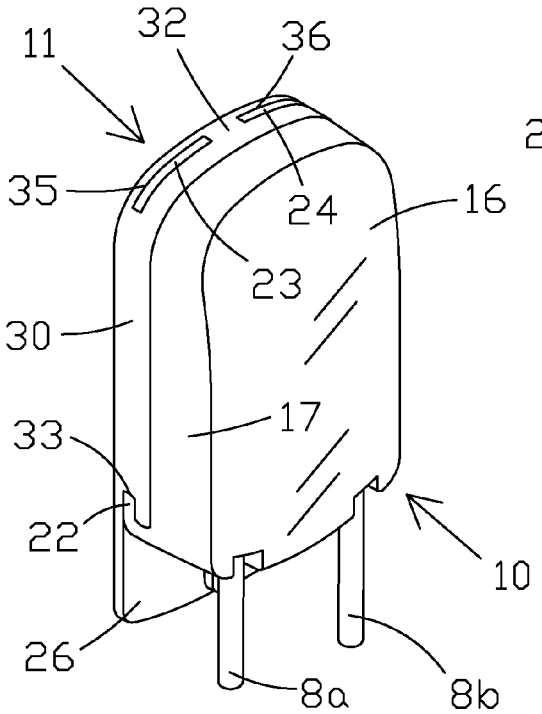
FIG. 9 shows, in perspective view, the support means of FIG. 2 connected to the connection element of FIG. 4.
Figure 10:
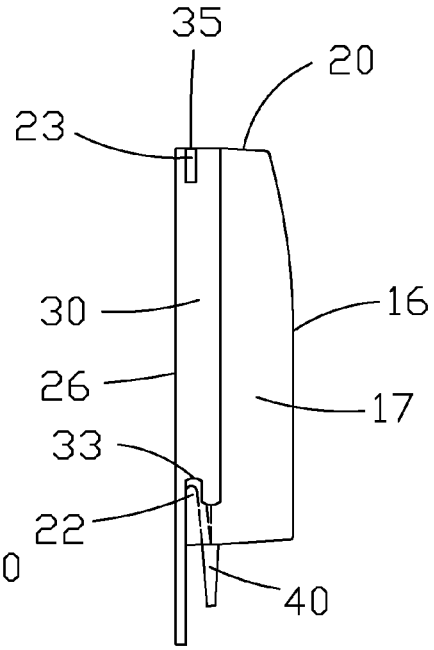
FIG. 10 shows the assembly of FIG. 9 in side view.

FIGS. 9 and 10 show the slide 10 and the connection element 11 at the end of said translation, thus to obtain the same configuration shown in FIG. 1. With reference to FIG. 9, it is possible to observe that the longitudinal walls 30 and 31 of the connection element 11 completely occupy the recess 21 at the longitudinal walls 17 and 18 of the slide 10, and the transverse wall 32 of the connection element 11 completely occupies the recess 21 at the transverse wall 20 of the slide 10. In addition, the protuberances 22 of the slide 10 completely occupy the grooves 33 and 34 of the connection element 11 and the tabs 23 and 24 of the slide 10 completely occupy the windows 35 and 36 of the transverse wall 29 of the connection element 11.

With reference to FIG. 10, it is possible to observe that the tongue 39 of the connection element 11 projects from the notch 25 of the slide 10 at the tooth 40. Due to the translation of the slide 10 on the connection element 11, the tooth 40 has exited outward from the notch 25 and is in contact with the transverse wall 19 of the slide 10. The distance of the free end of the tongue 39 from the base 26 of the connection element 11 is preferably less than the distance in the configuration illustrated in FIG. 6, but greater than the distance in the configuration illustrated in FIG. 8. Therefore, given that the tongue 39 is bent towards the base 26 of the connection element 11 with respect to the configuration of FIG. 6, due to said elastic return force, the tongue 39 is pressed at the rectilinear section 42 against the edge of the wall delimiting the notch 25 parallel to the base 15, common to the transverse wall 19.

In the configuration shown in FIGS. 9 and 10, the walls 30 and 31 and the grooves 33 and 34 of the connection element 11, together with the protuberances 22 of the slide 10, create a constraint between the slide 10 and the connection element 11 such that the slide 10 can only translate with respect to the connection element 11 parallel to the longitudinal walls 30 and 31 of the connection element 11, in the only direction such that the transverse wall 20 of the slide 10 moves away from the transverse wall 32 of the connection element 11. This situation of constraint is created even in the absence of the windows 35 and 36 of the connection element 11 and in the absence of the tabs 23 and 24 of the slide 10, as in the absence of the same transverse wall 32. Since the connection element 11 is fixed to the glass pane 3, preferably in a manner such that the longitudinal walls 30 and 31 are arranged vertically, said translation is vertical.

The tongue 39, having the tooth 40 in contact with the transverse wall 19 of the slide 10, prevents the latter from carrying out the abovementioned translation. The slide 10 is therefore immobilized against the connection element 11. Incidentally, in order to maintain the slide 10 in the configuration illustrated in FIGS. 9 and 10, it is no longer necessary to keep the slide 10 pressed against the connection element 11 since said elastic return force of the tongue 39 is overcome by the constraining reaction that is generated following the insertion of the protuberances 22 in the grooves 33 and 34 and the insertion of the tabs 23 and 24 in the windows 35 and 36.

The rope sections 8*a* and 8*b* are directed parallel to the longitudinal walls 30 and 31 of the connection element 11, and hence parallel to the grooves 33 and 34. The tension of the cord 8 ensures that the slide 10 is subjected to a traction force due to which the transverse wall 19 of the slide is pressed against the tooth 40 of the tongue 39. The elasticity of the tongue 39 is such that for a value of tension applied to at least one of the two cord sections 8*a* and 8*b* that is equal to or greater than a limit value, the tongue 39, due to the traction force acting on the slide 10 and due to the tension of the cord 8, is bent until there is no more contact between the transverse wall 19 of the slide 10 and the tooth 40 of the tongue 39. The slide 10 thus becomes free to translate parallel to the longitudinal walls 30 and 31 of the connection element 11. At the instant in which the tongue 39 releases the slide 10, the latter undergoes a traction due to the tension of the cord 8 that translates it. Due to such translation, the protuberances 22 exit outward from the grooves 33 and 34 and the tabs 23 and 24 exit outward from the windows 35 and 36. There is thus the separation of the slide 10 from the connection element 11 and the consequent cancellation of the tension of the cord 8. If the device 1 is, as previously said, preferably vertically arranged, i.e. with the ring of cord 8 lying in a vertical plane, the weight force of the slide 10 is summed with the tension of the cord 8 in facilitating the separation of the slide 10 from the connection element 11.

The limit tension value, above which there is the separation of the slide 10 from the connection element 11, is a "pre-established" value in the sense that it depends on the design parameters of the device 1, and usually on the shape of the tongue 39 and on the material with which it is obtained. The device 1 can therefore be designed in a manner so as to prevent improper uses of the cord 8. By way of example, by referring to the design parameters of the device 1 indicated above in the present description, said limit tension value is preferably comprised between 55 N and 61 N, and still more preferably is 60 N. This ensures the separation of the slide 10 from the connection element 11 when a weight greater than 6 kg is applied to the cord 8. In such a manner, one can prevent the possibility that a child could choke in a domestic accident, due to the cord 8.

Figure 12:
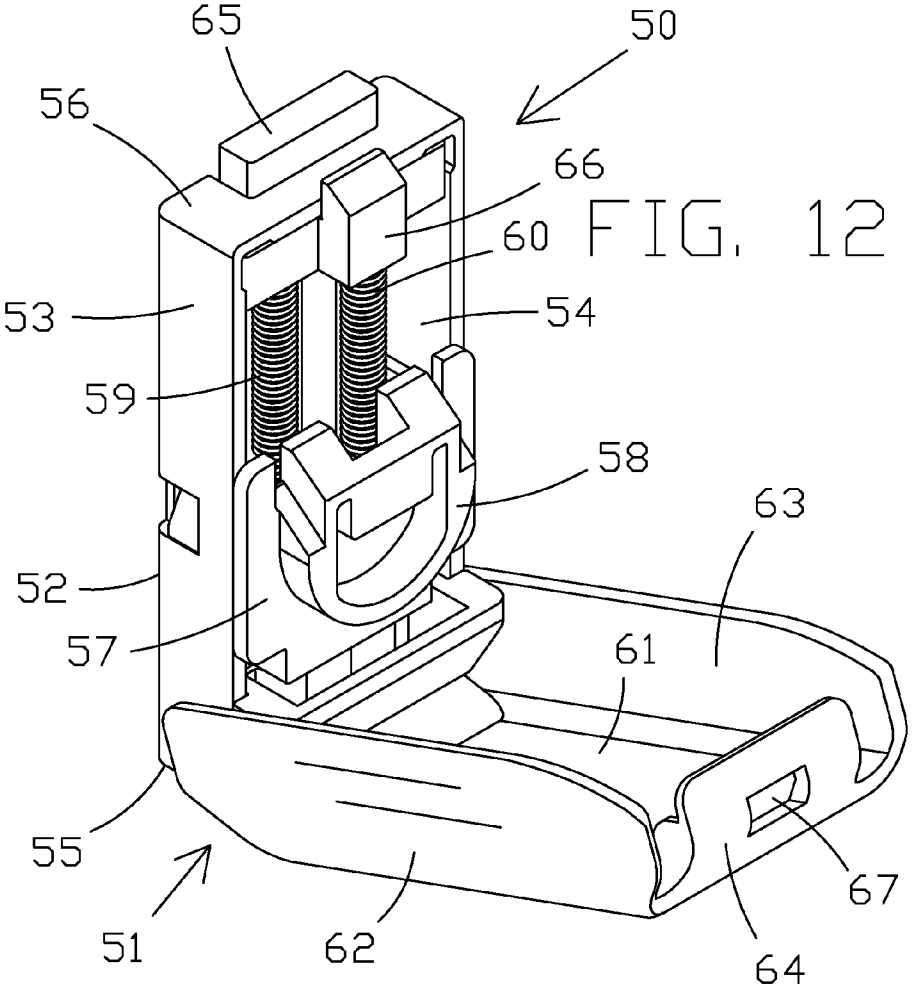
FIG. 12 shows, in perspective view, the tensioning means of FIG. 11 in open configuration for the application of the cord.
Figure 11:
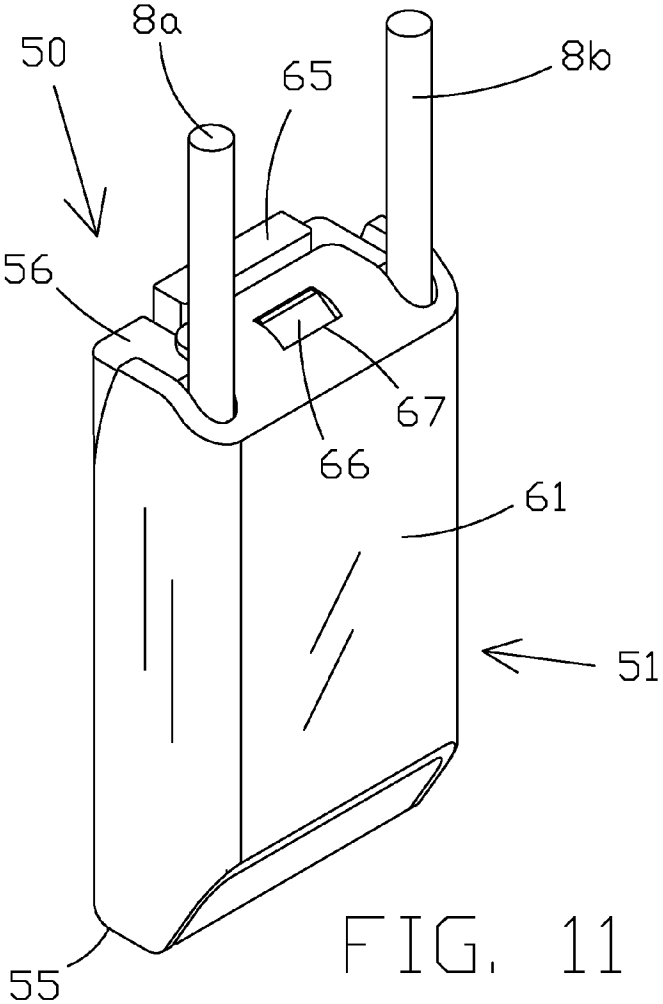
FIG. 11 shows, in perspective view, another component of the device of FIG. 1 acting as tensioning means for the cord.

With reference to the FIGS. 11 and 12, the tensioning element 9 of the cord 8 is illustrated. The tensioning element 9 comprises a container 50 in rectangular parallelepiped form, open at one face and closeable by means of a cover 51 that oscillates with respect to the container 50. The latter has a base 52 from which two mutually parallel longitudinal walls 53 and 54 and two mutually parallel transverse walls 55 and 56 extend orthogonally upward. The walls 53, 54, 55 and 56 have the same height. The tensioning element 9 is symmetric with respect to a plane parallel to the lateral walls 53 and 54 and orthogonal to the base 52. The container 50 is integrally connected to the glass pane 3 at the base 52, on the side opposite that of the walls 53, 54, 55 and 56. Preferably, the container 50 is fixed to the glass pane 3 with the walls 53 and 54 arranged vertically. The container 50 contains a pair of guide bars 70 and 71 (visible in FIG. 13) which are extended parallel to the longitudinal walls 53 and 54 from the transverse wall 55 to the transverse wall 56. A return element 57 of the cord 8 is free to translate on said guide bars 70 and 71. The return element 57 comprises a wall 58 having a form which is obtained by selecting a cylindrical surface along one of its longitudinal symmetry planes. The wall 58 projects from the container 50 orthogonally with respect to the base 52, with the concavity directed towards the transverse wall 56, and is traversed by the plane of symmetry of the tensioning element 9. Preferably, the wall 58 and the drive pulley are coplanar and have the same diameter. The guide bars 70 and 71 are inserted in two respective helical springs 59 and 60, coaxial with said bars, which work under compression by pressing the return element 57 against the transverse wall 55 of the container 50.

The cover 51 comprises a rectangular base 61 with extension slightly greater than the base 52 of the container 50, from whose long edges two longitudinal walls 62 and 63 are extended orthogonally upward. A transverse wall 64 extends upward from a short edge of the base 61 and orthogonally thereto. The walls 62, 63 and 64 have nearly the same height. The longitudinal walls 62 and 63 of the cover 51 are hinged, in proximity to the short edge of the base 61 opposite the transverse wall 64, to the longitudinal walls 53 and 54 of the container 50 and parallel thereto, in proximity to the transverse wall 55. The cover 51 oscillates with respect to the container 50 in a manner such that the longitudinal walls 62 and 63 of the cover 51 are maintained parallel to the longitudinal walls 53 and 54 of the container 50.

FIG. 11 shows the tensioning element 9 in the configuration in which the cover 51 closes the container 50, with the base 61 of the cover 51 arranged parallel to the base 52 of the container 50. FIG. 12 shows the tensioning element 9 in the maximum opening configuration, with the base 61 of the cover 51 arranged nearly orthogonal to the base 52 of the container 50.

As can be observed in FIG. 11, the cord sections 8*a* and 8*b* exit outward from the tensioning element 9, traversing the transverse wall 56 of the container 50 and the transverse wall 64 of the cover 51. As will be clearer in FIG. 13, the cord 8 is wound around the wall 58 of the return element 57 for a section equal to a semi-circumference. Given that the radius of the drive pulley is preferably equal to the radius of the semi-circumference described by the wall 58, the rope sections 8*a* and 8*b* are mutually parallel.

The tensioning element 9 comprises means for locking the cover 51 to the container 50 in the configuration shown in FIG. 11. These locking means comprise a button 65 projecting from the transverse wall 56 of the container 50 towards the exterior of the container 50. The button 65 is slidable on the same guide bars 70 and 71 of the return element 57 and is thrust towards the exterior of the container 50 by the springs 59 and 60. The latter are thus compressed between the return element 57 and the button 65. By pressing the button 65, in a manner so as to have it penetrate into the tensioning element 9, the button 65 tends to slide on said guide bars 70 and 71 towards the transverse wall 55, coming to further compress the springs 59 and 60. The button 65 is integrally connected to a tooth 66 that projects from the transverse wall 56 of the container 50, when the button 65 is completely extended, i.e. completely expelled from the container 50. The penetration of the button 65 in the container 50 through the transverse wall 56 involves the translation of the tooth 66 towards the transverse wall 55 of the container 50. The tooth 66 is therefore retractable and the springs 59 and 60 oppose the latter translation. The transverse wall 64 of the cover 51 has a window 67 that can be traversed by the tooth 66. As shown in FIG. 11, when the tensioning element 9 is situated in the closure position, the tooth 66, thrust by the springs 59 and 60, traverses the window 67 of the transverse wall 64 of the cover 51, preventing the latter from rotating with respect to the container 50. In order to open the tensioning element 9, i.e. in order to pass from the configuration shown in FIG. 11 to that shown in FIG. 12, it is necessary to press the button 65, making it penetrate into the container 50 in a manner so as to overcome the elastic force of the springs 59 and 60. The button 65 must be pressed as much as is required such that the tooth 66, entering into the tensioning element 9, exits from the window 67 of the transverse wall 64 of the cover 51, thus allowing the rotation of the latter with respect to the container 50.

Figure 13:
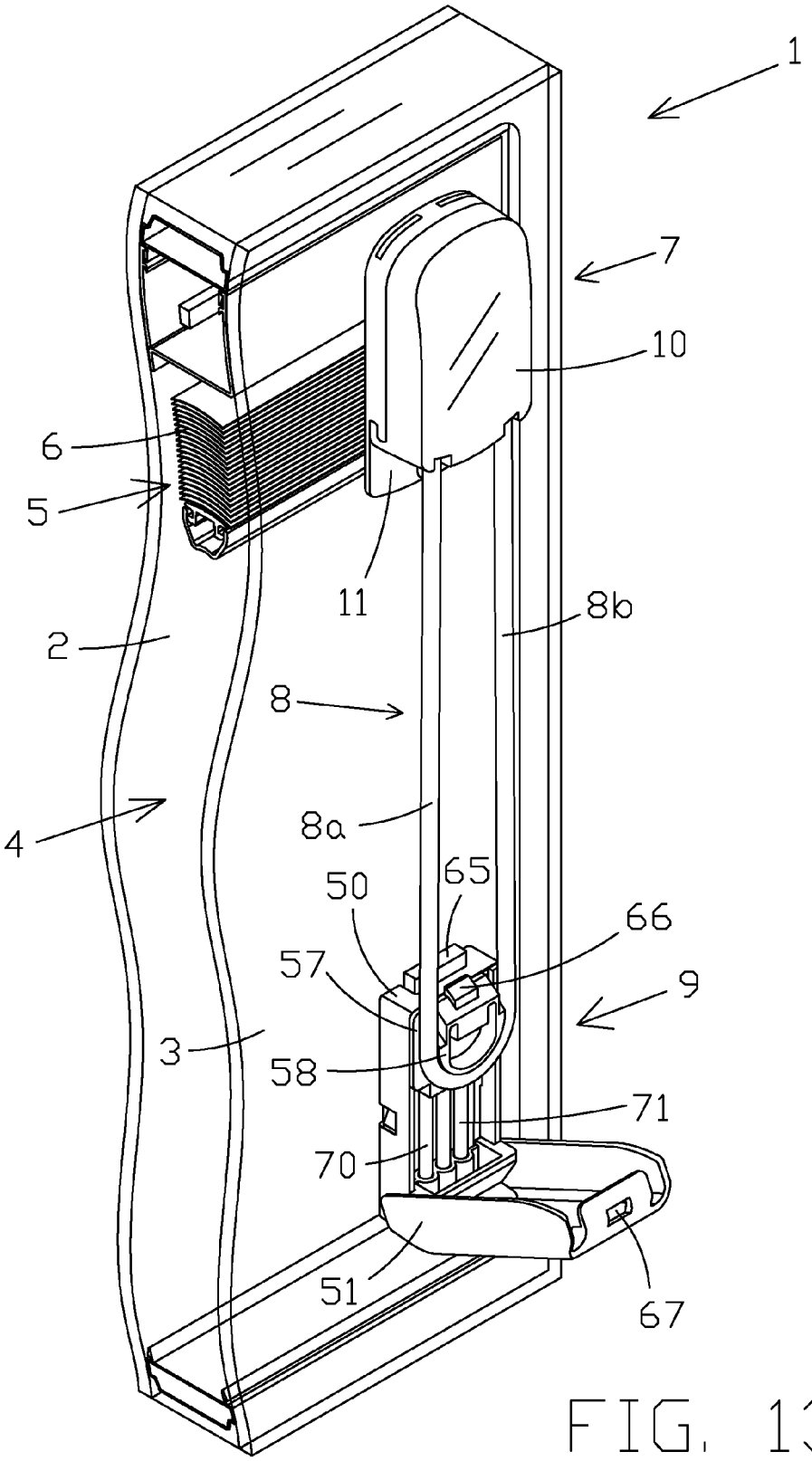
FIG. 13 shows, in perspective view, the device of FIG. 1 with the tensioning means of FIG. 11 in open configuration.

With reference to FIG. 13, the tensioning element 9 is illustrated that is applied to the glass pane 3 in the open configuration. In normal functioning conditions, the tensioning element 9 is in the closed configuration shown in FIGS. 1 and 11. The open configuration of FIG. 13 is shown for the purpose of illustrating that the return element 57, with respect to the position occupied in FIG. 12, is translated in proximity to the transverse wall 56 of the container 50. This is due to the tension of the cord 8, due to which there is a traction force that makes the return element 57 translate towards the transverse wall 56 of the container 50, further compressing the springs 59 and 60. The return element 57 translates until the elastic force of the springs 59 and 60 equals the traction force due to the tension of the cord 8. The further compression of the springs 59 and 60 increases the pressure to be exerted for pressing the button 65 in order to unlock the cover 51. The pressure to be exerted on the button 65 for opening the tensioning element 9, when it is situated in the configuration of FIG. 1, depends on the design parameters. In particular, the design parameters can be selected in a manner such that said pressure to be exerted on the button is clearly greater than the pressure that can be commonly exerted by a child. This constitutes a safety guarantee since in such a manner, the tensioning element 9 is not easily openable.

By way of example, making reference to the design parameters of the device 1 previously indicated in the present description, the springs 59 and 60 have an elastic constant preferably comprised between 0.0645 N/m and 0.0655 N/m, and still more preferably is 0.0650 N/m; the compression force to be applied to the button 65 in order to open the tensioning element 9 in operating conditions, in the configuration shown in FIG. 1, is 3 N.

A further advantage offered by the device 7 consists of the possibility of quickly releasing the control components of the curtain/awning with a simple click, if it is desired to block the functioning of the curtain/awning or provide for the cleaning of the glass pane 3.

The adhesion of the tensioning element 9 to the glass pane 3 maintains the cord ring 8 close to the glass pane 3. This constitutes a further safety guarantee since it prevents the accidental insertion of the head of a child in the cord ring. On the basis of the description provided for a preferred embodiment, it is obvious that some changes can be made by the man skilled in the art, without departing from the scope of the invention as defined by the following claims.

The invention claimed is:

1. A device (7) for moving a curtain/awning (5) housed in a double glazing (1), the curtain/awning (5) comprising slats (6) located within and translatable within the double glazing (1), said device (7) comprising:

a cord (8) that defines an endless ring, the cord (8) having two cord sections (8*a*, 8*b*) that define a first cord section (8*a*) extending parallel to a second cord section (8*b*), wherein applying a force to one of the two cord sections (8*a*, 8*b*) generated a torque that moves the one cord section in a first direction and moves the other cord section in an opposite, second direction, the cord being located on a first exterior side of a first glass pane (3) of the double glazing;

a tensioning element (9) connected to the first exterior side of the first glass pane (3) of the double glazing, a lower distal end of the endless ring defined by the cord (8) being retained within the tensioning element (9) with the first and second cord sections (8*a*, 8*b*) extending upward from the tensioning element (9), wherein the tensioning element (9) covers the lower distal end of the endless ring defined by the cord (8) and conceals the lower distal end of the endless ring from exterior view;

a connection element (11) integrally connected to the first exterior side of the first glass pane (3) of the double glazing; and a container (10) connected, via the connection element (11), to the first exterior side of the first glass pane (3) of the double glazing with the connection element (11) located between the container (10) and the first exterior side of the first glass pane (3), an upper distal end of the endless ring defined by the cord (8) being retained within the container (10) with the first and second cord sections (8*a*, 8*b*) extending downward from the container (10) to the connection element (11), wherein the container (10) i) covers the connection element (11) and ii) covers and supports the upper distal end of the endless ring defined by the cord (8) and conceals the upper distal end of the endless ring from exterior view, wherein the endless ring defined by the cord (8) is rotatable between the container (10) and the connection element (11) and the torque, generated from applying the force to one of the two cord sections, causes translation of the slats (6) of the curtain/awning (5) housed in a double glazing (1), and wherein the connection element (11) disconnectably supports the container (10) such that i) when a value of tension applied to at least one of said two cord sections (8*a*, 8*b*) that is lower than a pre-established value, the connection element (11) supports the container (10), and ii) when the value of tension applied to the at least one of said two cord sections (8*a*, 8*b*) exceeds the pre-established value causes separation of the container (10) from the connection element (11) by translation of the container (10) with respect to the connection element (11).

2. The device (7) according to claim 1, wherein the separation of the container (10) from the connection element (11) cancels the tension of the cord (8).

3. The device (7) according to claim 1, wherein said connection element (11) comprises:

a base (26) with a top edge, a bottom edge, and two edges (27, 28) extending upwardly from the bottom edge to the top edge, two mutually parallel longitudinal walls (30, 31) respectively extending out with respect to the base (26), along the upwardly extending edges (27, 28), a transverse top wall (32) extending out with respect to the base (26), along the top edge of the base, the transverse wall extending between top parts of the two longitudinal walls (30, 31), two respective longitudinal grooves (33, 34) extending parallel to the base (26) and starting respectively in a lowermost part of each of the two longitudinal walls (30, 31), and a tongue (39) having i) a first end connected to the base (26) at a connection section (38), the tongue (39) is extended towards the lower edge of the base (26), and ii) an opposite, second end having a tooth (40) that extends outward from the base (26), wherein the tongue and tooth are operatively engaged with the container (10) to disconnectably support the container (10) such that i) when the value of tension applied to the at least one of said two cord sections (8*a*, 8*b*) that is lower than the pre-established value, the tongue and tooth support the container (10), and ii) when the value of tension applied to the at least one of said two cord sections (8*a*, 8*b*) exceeds the pre-established value causes separation of the container (10) from the tongue and tooth by translation of the container (10) with respect to the tongue and tooth.

4. The device (7) according to claim 3, wherein, said container (10) includes two protuberances (22), each of said two protuberances (22) being insertable, by sliding along a first direction of translation, into a respective one of the two longitudinal grooves (33, 34) so that the container (10) is connected, via the connection element (11), to the first exterior side of the first glass pane (3) of the double glazing, and the sliding of the two protuberances (22) into the two longitudinal grooves (33, 34) translates of the container (10) with respect to the connection element (11) into an engaged position where the tongue and tooth are engaged with the container (10).

5. The device (7) according to claim 3, wherein, in said engaged position, the container (10) is pressed with a pressure against the tooth (40) at a contact zone, and the first end of the tongue (39) and said contact zone are arranged along a direction oblique to the first direction of said translation, the pressure of the container (10) against said tooth (40) causing, for a value of tension applied to at least one of said cord sections (8*a*, 8*b*) that is equal to or greater than said pre-established value, a bending of the tongue (39) due to which contact between the container (10) and the tooth (40) is reduced until the contact is nullified and the container (10) separated from the tongue and tooth and the container (10) separates from the connection element (11).

6. The device (7) according to claim 1, wherein the tensioning element (9) comprises:

a tensioning element base (52) connected to the first exterior side of the first glass pane (3) of the double glazing, a cover (51) that closes to cover the tensioning element base (52) and cover the lower distal end of the endless ring defined by the cord (8) and conceals the lower distal end of the endless ring from exterior view, a return element (57) around which the cord is at least partially wound, the return element (57) being connected to tensioning element base (52) and being adjustable to provide an adjustable tension of the cord (8), and a lock mechanism (66) that locks the cover (51) to the tensioning element base (52) such that the cover (51) covers the return element (57).

7. The device (7) according to claim 6, wherein, said cover (51) includes an opening (67), and said lock mechanism (66) comprises i) a retractable tooth (66) housable in the opening (67), housing of the retractable tooth (66) in said opening (67) preventing the cover (51) from rotating with respect to the tensioning element base (52), and ii) at least one spring (59, 60) that is compressed with an elastic force that keeps the retractable tooth (66) extended into the opening (67), the cover (51) being adapted to be released only by exerting a pressure on the retractable tooth (66) that is greater than the elastic force of the spring (59, 60).

8. The device (7) according to claim 7, wherein, the at least one spring (59, 60) comprises two helical springs (59, 60), and the return element (57) is connected to said tensioning element base (52) by guide bars (70, 71) that extended along the tensioning element base (52), and each of the guide bars (70, 71) being inserted in a respective one of the two helical springs (59, 60), with each said helical spring (59, 60) being compressed between said retractable tooth (66) and the return element (57) so that the tension of the cord (8) further compresses the spring (59, 60).

9. A device (7) for moving a curtain/awning (5) housed in a double glazing (1), the curtain/awning (5) comprising slats (6) located within and translatable within the double glazing (1), said device (7) comprising:

a cord (8) that defines an endless ring, the cord (8) having two cord sections (8*a*, 8*b*) that define a first cord section (8*a*) extending parallel to a second cord section (8*b*), wherein applying a force to one of the two cord sections (8*a*, 8*b*) generated a torque that moves the one cord section in a first direction and moves the other cord section in an opposite, second direction, the cord being located on a first exterior side of a first glass pane (3) of the double glazing;

a connection element (11) connected to the first exterior side of the first glass pane (3) of the double glazing; and a container (10) connected, via the connection element (11), to the first exterior side of the first glass pane (3) of the double glazing with the connection element (11) located between the container (10) and the first exterior side of the first glass pane (3), an upper distal end of the endless ring defined by the cord (8) being retained within the container (10) with the first and second cord sections (8*a*, 8*b*) extending downward from the container (10) to the connection element (11), wherein the container (10) i) covers an outermost surface of the connection element (11) and ii) covers and supports the upper distal end of the endless ring defined by the cord (8) and conceals the upper distal end of the endless ring defined by the cord (8) from exterior view, wherein the endless ring defined by the cord (8) is rotatable between the container (10) and the connection element (11) and the torque, generated from applying the force to one of the two cord sections, causes translation of the slats (6) of the curtain/awning (5) housed in a double glazing (1), and wherein the connection element (11) disconnectably supports the container (10) such that i) when a value of tension applied to at least one of said two cord sections (8*a*, 8*b*) that is lower than a pre-established value, the connection element (11) supports the container (10), and ii) when the value of tension applied to the at least one of said two cord sections (8*a*, 8*b*) exceeds the pre-established value causes separation of the container (10) from the connection element (11) by translation of the container (10) with respect to the connection element (11).

10. The device (7) of claim 9, wherein said connection element (11) comprises:

a base (26) with a top edge, a bottom edge, and two edges (27, 28) extending upwardly from the bottom edge to the top edge, two longitudinal walls (30, 31) respectively extending out from the base (26), along the upwardly extending edges (27, 28), two respective longitudinal grooves (33, 34) extending parallel to the base (26) and starting respectively in a lowermost part of each of the two longitudinal walls (30, 31) and opening toward the lower edge of the base (26), and a tongue (39) having i) a first end connected to the base (26) and an opposite, second end having a tooth (40) that extends outward from the base (26), wherein the tongue and tooth are operatively engaged with the container (10) to disconnectably support the container (10) such that i) when the value of tension applied to the at least one of said two cord sections (8*a*, 8*b*) that is lower than the pre-established value, the tongue and tooth support the container (10), and ii) when the value of tension applied to the at least one of said two cord sections (8*a*, 8*b*) exceeds the pre-established value causes separation of the container (10) from the tongue and tooth by translation of the container (10) with respect to the tongue and tooth.

11. The device (7) of claim 10, wherein, the container (10) includes two protuberances (22), each of the two protuberances (22) being insertable, by sliding the container along a first direction of translation, into a respective one of the two longitudinal grooves (33, 34) so that the container (10) is connected, via the connection element (11), to the first exterior side of the first glass pane (3) of the double glazing, and the sliding of the two protuberances (22) into the two longitudinal grooves (33, 34), along the first direction of translation, translates of the container (10) with respect to the connection element (11) into an engaged position where the tongue and tooth are engaged with the container (10).

12. The device (7) of claim 11, wherein, in said engaged position, the container (10) is pressed with a pressure against the tooth (40) at a contact zone, the pressure of the container (10) against said tooth (40) causing, for a value of tension applied to at least one of said cord sections (8*a*, 8*b*) that is greater than said pre-established value, a bending of the tongue (39) toward the base (26) that allows separation of the container (10) from the tongue and tooth from the container (10) to thereby separate the container (10) from the connection element (11).

13. The device (7) of claim 9, further comprising a tensioning element (9) connected to the first exterior side of the first glass pane (3) of the double glazing, a lower distal end of the endless ring defined by the cord (8) being retained within the tensioning element (9) with the first and second cord sections (8*a*, 8*b*) extending upward from the tensioning element (9), wherein the tensioning element (9) covers the lower distal end of the endless ring defined by the cord (8) and conceals the lower distal end of the endless ring defined by the cord (8) from exterior view.

14. The device (7) of claim 13, wherein the tensioning element (9) comprises:

a tensioning element base (52) connected to the first exterior side of the first glass pane (3) of the double glazing, a cover (51) that closes to cover the tensioning element base (52) and cover the lower distal end of the endless ring defined by the cord (8) and conceals the lower distal end of the endless ring defined by the cord (8) from exterior view, a return element (57) around which the cord is wound, the return element (57) being connected to tensioning element base (52) and being adjustable to provide an adjustable tension of the cord (8), and a lock mechanism (66) that locks the cover (51) to the tensioning element base (52) such that the cover (51) covers the return element (57).

15. The device (7) of claim 14, wherein, said cover (51) includes an opening (67), and said lock mechanism (66) comprises i) a retractable tooth (66) housable in the opening (67), housing of the retractable tooth (66) in said opening (67) preventing the cover (51) from rotating with respect to the tensioning element base (52), and ii) a spring (59, 60) that is compressed with an elastic force that keeps the retractable tooth (66) extended into the opening (67), the cover (51) being adapted to be released only by exerting a pressure on the retractable tooth (66) that is greater than the elastic force of the spring (59, 60).

16. The device (7) according to claim 15, wherein, the spring (59, 60) is a helical spring (59, 60), and the return element (57) is connected to said tensioning element base (52) by a guide bar (70, 71) that extends along the tensioning element base (52), and the guide bar (70, 71) is located with in two helical spring (59, 60), with the helical spring (59, 60) being compressed between said retractable tooth (66) and the return element (57) so that adding the tension on the cord (8) further compresses the spring (59, 60).

* * * * *